US005649625A

United States Patent [19]

Ovadia

[11] Patent Number: 5,649,625

[45] Date of Patent: Jul. 22, 1997

[54] RING TRAY WITH NESTING RING SUPPORTS

[76] Inventor: Joseph Ovadia, 109 Long Hill Rd., Little Falls, N.J. 07424

[21] Appl. No.: 465,144

[22] Filed: Jun. 5, 1995

[51] Int. Cl.[6] ..... B65D 85/02

[52] U.S. Cl. ..... 206/566; 206/6.1; 206/493

[58] Field of Search ..... 206/6.1, 493, 557, 206/558, 560–562, 565, 566

[56] References Cited

U.S. PATENT DOCUMENTS

| | | | |
|---|---|---|---|
| 542,751 | 7/1895 | Boyden | 206/566 |
| 2,646,953 | 7/1953 | Cinami | 206/566 |
| 2,963,149 | 12/1960 | Bergh et al. | 206/566 |
| 3,197,166 | 7/1965 | Sandler | 206/566 |
| 4,282,975 | 8/1981 | Ovadia . | |
| 4,341,300 | 7/1982 | Roy | 206/566 |
| 4,432,456 | 2/1984 | Ovadia . | |
| 5,511,653 | 4/1996 | Ovadia | 206/566 |

*Primary Examiner*—Jimmy G. Foster
*Attorney, Agent, or Firm*—Richard M. Goldberg

[57] ABSTRACT

A ring tray includes a frame having a peripheral supporting wall, a supporting structure connected within the peripheral supporting wall, the supporting structure including a plurality of through holes therein, and a plurality of intersecting walls connected within the peripheral supporting wall and formed on the supporting structure so as to define a plurality of recesses; and a plurality of pads removably mounted in the recesses on the supporting structure, each pad including a square planar support having an opening therein and removably mounted on the supporting structure in alignment with a respective through hole, and a hollow frusto-conical ring post extending upwardly at an acute angle from the support in surrounding relation to the opening therein for supporting a ring thereon.

21 Claims, 5 Drawing Sheets

RING TRAY WITH NESTING RING SUPPORTS

BACKGROUND OF THE INVENTION

The present invention relates generally to display and storage devices, and more particularly, is directed to a ring tray for storing and displaying rings.

Conventionally, there have been two general types of ring trays.

In one known ring tray, there is a rectangular frame with a central rectangular opening therein and an inwardly extending peripheral ledge. A bottom closing member is secured to the tray so as to close the underside of the tray, and is formed with a plurality of recesses therein in a generally honeycomb pattern. A top pad is secured to and closes the top of the tray. In this known ring tray, the top pad includes a thin lower sheet made of a rubber or similar material that is glued to the peripheral ledge of the frame, the lower sheet having a plurality of die cut slits formed therein which are aligned with each recess. In this manner, a ring can be pushed through a slit in the lower sheet so that it is held by the rubber material and seats in a recess. In order to provide an aesthetic appearance, an upper fabric pad having a plurality of openings is adhered to the upper surface of the lower sheet so that openings in the upper fabric pad are aligned with the slits in the lower sheet.

However, with such known ring tray, one-half of the ring is hidden from view in the top pad where it is held.

Further, over continued usage, the top pad has a tendency to detach and lift up at the edges thereof, that is, at its attachment to the inwardly extending peripheral ledge of the frame. Accordingly, in order to prevent the same from occurring as readily, and even if it does occur, to prevent detraction of the appearance of the ring tray, it has been necessary to provide the inwardly extending peripheral ledge at a position below the upper edge of the frame. Since the ring trays are intended to stack one upon the other, this means that it is necessary to increase the height of the ring tray. This is particularly disadvantageous from a space saving standpoint, and particularly disadvantageous when a salesman has to carry a plurality of these stacked trays.

With such an arrangement, when a plurality of such trays are stacked upon each other, the rings seated in a lower tray extend into recesses of the honeycomb pattern, which are also formed at the undersurface of the bottom closing member of the next upper tray stacked thereon. However, because of the use of such honeycomb pattern, it is necessary that the stacked trays be oriented in reverse to each other, that is, 180° turned with respect to each other. As a result, it becomes more burdensome to stack and unstack the trays.

Still further, with such known ring tray, since the rings are only held by the rubber lower sheet, the rings tend to seat at different angles in the different recesses. This detracts from the aesthetic appearance.

As an alternative to the above, another ring tray is known which similar to the aforementioned ring tray. Specifically, rather than using a lower rubber sheet, a thin fabric sheet is used in place thereof. Since the thin fabric sheet provides substantially no holding force, as occurs with a rubber sheet, a foam pad is provided so as to seat in each recess and thereby hold the rings. The thin fabric sheet is adhered to the peripheral ledge and to the upper surface of the foam pad. After the thin fabric sheet is adhered to the foam pad, a plurality of slits are die cut therein. This results in the foam pad being likewise die cut and thereby aligned with the slits in the thin fabric sheet. In this manner, a ring can be pushed through a slit in the thin fabric sheet and held by the foam. An upper fabric pad having a plurality of openings is adhered to the upper surface of the thin fabric sheet, with the openings in alignment with the slits.

This latter known ring tray provides the same disadvantages as the aforementioned known ring tray as to detachment of the top pad from the inwardly extending peripheral ledge of the frame, and as to stacking of the trays. In addition, over continued usage, the thin fabric sheet tends to push outwardly from the slit, that is, the thin fabric sheet tends to move and remain outwardly of the slit, so as to take on an accordion configuration. As a result, each slit in the thin fabric sheet, over time, expands into a wider opening. Because the thin fabric sheet is adhered to the foam pad, it causes the foam pad to likewise open up and form a permanent V-shaped opening. Accordingly, the foam pad is no longer able to stably hold a ring, such that the rings can easily fall out, and even if they do not fall out, will be angled so as present an aesthetically unpleasant appearance.

Further, since the above ring trays are made from a plurality of different elements and layers, the cost and complexity of manufacturing the same is great.

In addition to the above type of ring tray in which the rings fit within openings in the top pad, another type of ring tray is known in which tapered cylindrical or frusto-conical ring supports or posts are fixed to a board of a ring tray by nails, so as to extend upwardly at an angle therefrom. The board and the ring posts are covered with a fabric material to provide an aesthetic appearance. However, with such ring trays, the ring posts are made of wood and are solid. Thus, stacking of the ring trays is not possible. Further, the cost and complexity of manufacturing the same is great.

OBJECTS AND SUMMARY OF THE INVENTION

Accordingly, it is an object of the present invention to provide a ring tray that overcomes the problems with the aforementioned prior art.

It is another object of the present invention to provide a ring tray having hollow ring posts that receive rings from another tray on which it is stacked.

It is still another object of the present invention to provide such a ring tray in which the hollow posts are part of respective pads that are removably fit within each ring tray.

It is another object of the present invention to provide a ring tray in which rear portions of the hollow posts are open to receive ring tags therein.

It is yet another object of the present invention to provide a ring tray having a reduced height in comparison with known ring trays.

It is a further object of the present invention to provide a ring tray that uses a reduced amount of material in comparison with conventional ring trays.

It is a still further object of the present invention to provide a ring tray in which the rings all face in the same direction when the ring trays are stacked upon each other.

It is a yet further object of the present invention to provide a ring tray having guiding walls for gripping a ring band therebetween.

It is another object of the present invention to provide a ring tray in which the guiding walls have cut-out areas that can receive a setting from a ring mounted on a lower ring tray on which the ring tray is stacked.

It is still another object of the present invention to provide an interlocking relation between rings of an upper ring tray and rings of a lower ring tray on which the upper ring tray is stacked.

It is yet another object of the present invention to provide a ring tray having recesses for receiving jewelry pads therein, with opposing grooves being cut at lower ends of the peripheral side wall of the recesses to capture lower ends of a jewelry pad therein.

It is a further object of the present invention to provide a ring tray that is extremely lightweight and durable, and easy and economical to manufacture and use.

In accordance with an aspect of the present invention, a ring tray includes a frame including a peripheral supporting wall, and a supporting structure connected within the peripheral supporting wall, the supporting structure including a plurality of through holes therein; and a plurality of pads removably mounted on the supporting structure, each pad including a support having an opening therein and removably mounted on the supporting structure in alignment with a respective through hole, and a hollow ring post extending upwardly from the support in surrounding relation to the opening therein for supporting a ring thereon.

The hollow ring post has a substantially frusto-conical configuration. Further, the support has a substantially planar surface and the ring post extends at an acute angle with respect to the planar surface and is integrally molded with the support.

In one modification, a rear portion of each hollow ring post is open to receive a ring tag therein.

The supporting structure includes a generally planar supporting wall connected to and between the peripheral supporting wall having the through holes therein, and the frame further includes a plurality of intersecting walls connected within the peripheral supporting wall and formed on the supporting structure so as to define a plurality of recesses for separately containing respective pads therein, with each through hole being provided in a respective recess.

Preferably, the peripheral supporting wall includes outer tray supporting vertical wall means for supporting the ring tray on a surface; short stacking ledge means, extending inwardly from an upper edge of the outer tray supporting vertical wall means, for supporting a bottom edge of the outer tray supporting vertical wall means of another the ring tray thereon; and inner supporting vertical wall means extending from the short stacking ledge means for supporting the supporting structure at a lower edge thereof.

In accordance with another aspect of the present invention, a ring tray includes a peripheral supporting wall; a supporting structure connected within the peripheral supporting wall, the supporting structure including a plurality of through holes therein; and a plurality of hollow ring posts extending upwardly from the supporting structure, each ring post being in surrounding relation to a respective through hole for supporting a ring thereon.

As with the first embodiment, the hollow ring post has a substantially frusto-conical configuration. Further, the supporting structure has a substantially planar surface and each ring post extends at an acute angle with respect to the planar surface, and is integrally molded with the supporting structure.

The supporting structure, intersecting walls and peripheral supporting wall are constructed in the same manner as the first embodiment.

In accordance with still another aspect of the present invention, a ring pad for use with a frame including a peripheral supporting wall, and a supporting structure connected within the peripheral supporting wall, the supporting structure including a plurality of through holes therein, includes a support removably mountable on the supporting structure and having an opening therein for alignment with a respective through hole when the support is removably mounted on the supporting structure, and a hollow ring post extending upwardly from the support in surrounding relation to the opening therein for supporting a ring thereon.

In accordance with yet another aspect of the present invention, a ring tray includes a frame including a peripheral supporting wall, and a supporting structure connected within the peripheral supporting wall, the supporting structure including a plurality of through holes therein; and a plurality of pads, each pad including an elevated wall structure removably mounted on the supporting structure in surrounding relation to a respective through hole, the elevated wall structure including an elongated slot therein, and at least one guiding wall connected to the elevated wall structure in surrounding relation to the elongated slot and extending downwardly from the elevated wall structure at an acute angle to the supporting structure when the pad is mounted on the supporting structure, for holding a ring therein such that the ring is oriented at the acute angle.

Specifically, the elevated wall structure includes a front inclined wall and a rear inclined wall meeting at an upper apex line, with lower ends thereof removably mounted on opposite sides of a respective through hole. The front inclined wall and rear inclined wall form a generally inverted V-shape with lower ends thereof removably mounted on opposite sides of a respective through hole. End walls are connected to opposite side edges of the front inclined wall and the rear inclined wall.

In one embodiment, the front inclined wall includes the elongated slot therein, and the at least one guiding wall extends from the front inclined wall in surrounding relation to the elongated slot, and substantially parallel to the rear inclined wall. Specifically, the at least one guiding wall includes first and second guiding walls extending from the front inclined wall in surrounding relation to the elongated slot, and arranged in spaced relation to the rear inclined wall, the first and second guiding walls being in parallel, spaced relation to each other for holding a ring therein.

In another embodiment, the front inclined wall includes the elongated slot therein, and the at least one guiding wall extends from the front inclined wall on one side of the elongated slot, and substantially parallel to the rear inclined wall, so as to define a cavity with the rear inclined wall for holding a ring therein.

Preferably, each guiding wall includes an opening therein for receiving therein a ring setting of a ring mounted on a lower stacked ring tray.

Further, the frame further includes a plurality of raised wall structures connected with the supporting structure in surrounding relation to respective through holes, for supporting the pads thereon. Each raised wall structure includes a shape similar to the elevated wall structure.

Thus, the raised wall structure includes a front inclined wall and a rear inclined wall meeting at an upper apex line, with lower ends thereof connected to the supporting structure on opposite sides of a respective through hole, with the at least one guiding wall being supported by the rear inclined wall of the raised wall structure and the front inclined wall of the elevated wall structure being supported by the front inclined wall of the raised wall structure.

The front inclined wall and rear inclined wall of the raised wall structure form a generally inverted V-shape with lower ends thereof connected to the supporting structure on opposite sides of a respective through hole.

Further, the rear inclined wall of the raised wall structure includes an opening therein in alignment with each opening of the at least one guiding wall.

The structure of the peripheral supporting wall is the same as in the first embodiment.

In addition, the supporting structure includes a plurality of recesses therein, each recess being defined by the bottom wall of the supporting structure and a peripheral side wall surrounding one through hole.

In a preferred embodiment, the peripheral side wall includes first and second opposite spaced apart side walls, with lower ends of the first and second opposite spaced apart parallel side walls of the peripheral side wall of each recess have an elongated opening extending therethrough to define opposite grooves for receiving opposite lower ends of a respective pad so as to removably capture the pad in the recess. Specifically, the peripheral side wall has a four-sided configuration with said opposite first and second walls connected together by third and fourth walls, one groove extending in lower portions of the first wall and portions of the third and fourth walls, and the other groove extending in lower portions of the second wall and portions of the third and fourth walls.

In accordance with a further aspect of the present invention, a ring tray includes a peripheral supporting wall; a supporting structure connected within the peripheral supporting wall, the supporting structure including a plurality of through holes therein; an elevated wall structure removably connected to the supporting structure in surrounding relation to each through hole, the elevated wall structure including an elongated slot therein; and at least one guiding wall connected to the elevated wall structure in surrounding relation to the slot and extending downwardly from the elevated wall structure at an acute angle to the supporting structure, for holding a ring such that the ring is oriented at the acute angle.

The elevated wall structure includes a front inclined wall and a rear inclined wall meeting at an upper apex line, with lower ends thereof connected to the supporting structure on opposite sides of each through hole. Thus, the front inclined wall and rear inclined wall form a generally inverted V-shape with lower ends thereof connected to the supporting structure on opposite sides of each through hole.

The front inclined wall includes the elongated slot therein, and the at least one guiding wall extends from the front inclined wall in surrounding relation to the elongated slot, and substantially parallel to the rear inclined wall.

The at least one guiding wall includes first and second guiding walls extending from the front inclined wall in surrounding relation to the elongated slot, and arranged in spaced relation to the rear inclined wall, the first and second guiding walls being in parallel, spaced relation to each other for holding a ring therein.

Further, each guiding wall includes at least one opening therein for receiving therein a ring setting of a ring mounted on a lower stacked ring tray.

In accordance with a still further aspect of the present invention, a ring pad for use with a frame including a peripheral supporting wall, and a supporting structure connected within the peripheral supporting wall, the supporting structure including a plurality of through holes therein, includes an elevated wall structure removably mountable on the supporting structure in surrounding relation to a respective through hole, the elevated wall structure including an elongated slot therein, and at least one guiding wall connected to the elevated wall structure in surrounding relation to the slot and extending downwardly from the elevated wall structure at an acute angle to the supporting structure when the pad is mounted on the supporting structure, for holding a ring such that the ring is oriented at the acute angle.

In accordance with a yet further aspect of the present invention, a jewelry tray includes a peripheral supporting wall; a center pad supporting portion connected within the peripheral supporting wall, the pad supporting portion including a bottom wall and at least one recess, each recess being defined by a peripheral side wall and the bottom wall, and the peripheral side wall includes first and second opposite spaced apart side walls; and lower ends of the first and second opposite spaced apart parallel side walls of the peripheral side wall of each recess have an elongated opening extending therethrough to define opposite grooves for receiving opposite lower ends of a jewelry pad so as to removably capture the jewelry pad in the recess.

Specifically, the peripheral side wall has a four-sided configuration with the opposite first and second walls connected together by third and fourth walls, one groove extending in lower portions of the first wall and portions of the third and fourth walls, and the other groove extending in lower portions of the second wall and portions of the third and fourth walls.

The above and other objects, features and advantages of the invention will become readily apparent from the following detailed description thereof which is to be read in connection with the accompanying drawings.

DETAILED DESCRIPTION OF THE PREFERRED EMBODIMENTS

Figure 1:
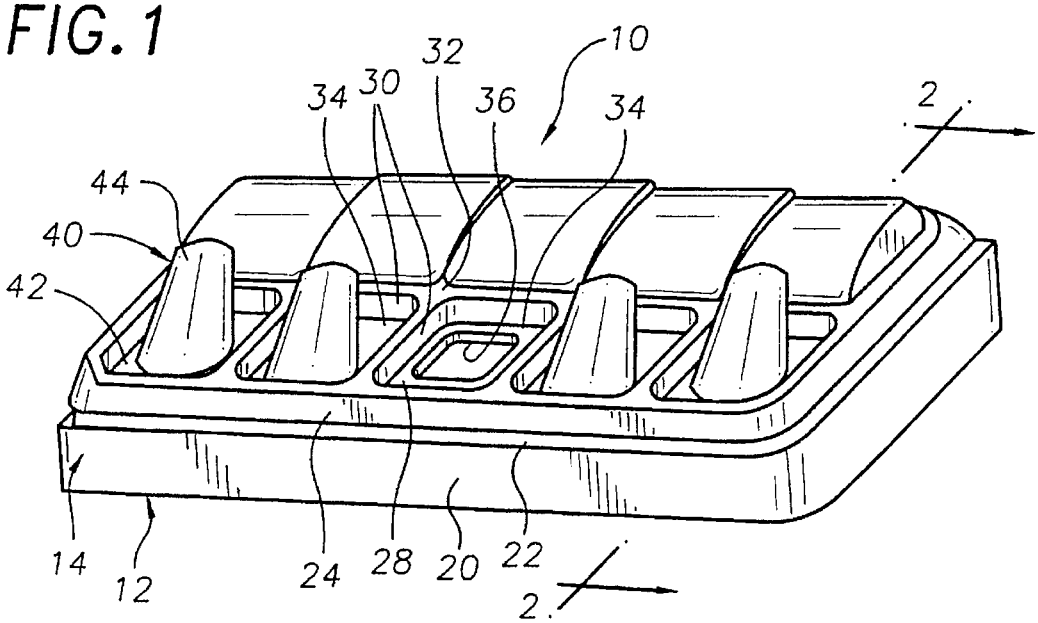
FIG. 1 is a perspective view of a ring tray according to one embodiment of the present invention.

Referring to the drawings in detail, and initially to FIGS. 1–4 thereof, a ring tray 10 according to one embodiment of the present invention includes a molded generally rectangular frame 12 made from a tough, lightweight plastic. Although frame 12 is shown in a rectangular configuration, it is not so limited. As shown, frame 12 includes a peripheral side wall 14, which is formed in a substantially rectangular configuration. Side wall 14 is formed by a peripheral outer tray supporting vertical wall 20, a peripheral short stacking ledge 22 extending inwardly from the upper edge of peripheral outer tray supporting vertical wall 20, a peripheral inclined wall 24 extending inwardly and upwardly from the inner edge of peripheral short stacking ledge 22, and a peripheral inner supporting vertical wall 26 extending downwardly from the inner, upper edge of peripheral inclined wall 24 so as to be parallel and spaced inwardly of peripheral outer tray supporting vertical wall 20.

Figure 2:
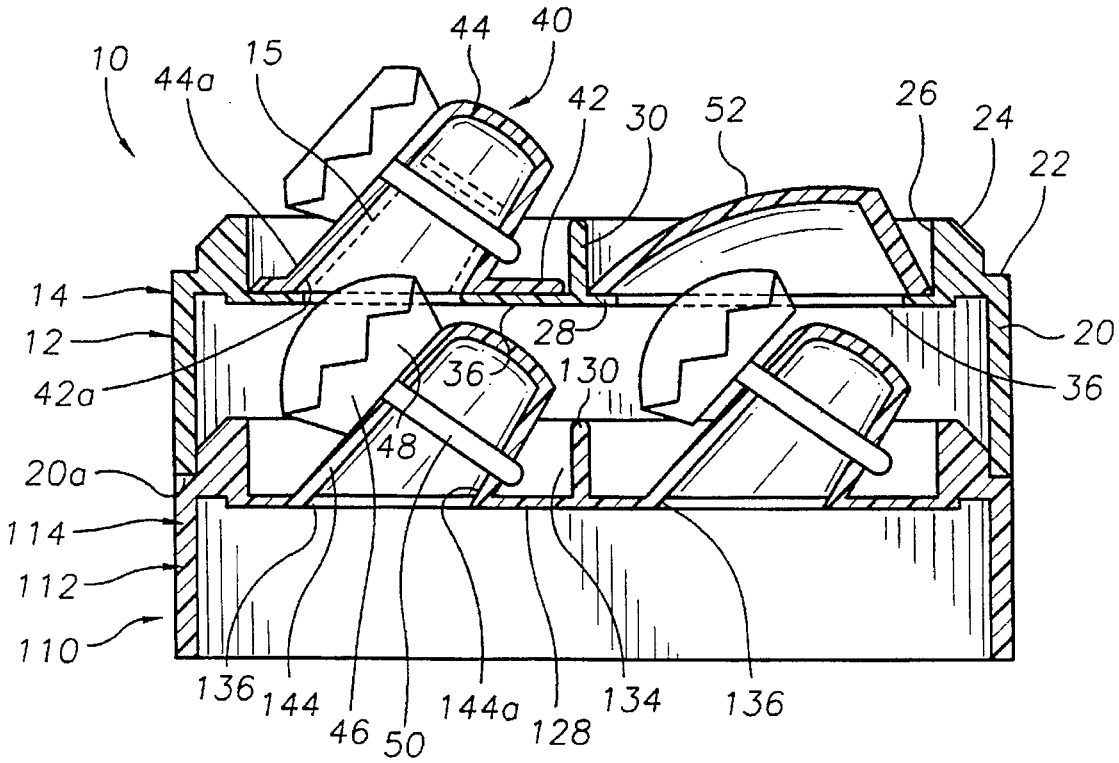
FIG. 2 is a cross-sectional view of the ring tray of FIG. 1, taken along line 2—2 thereof, stacked upon a ring tray according to another embodiment of the present invention.
Figure 4:
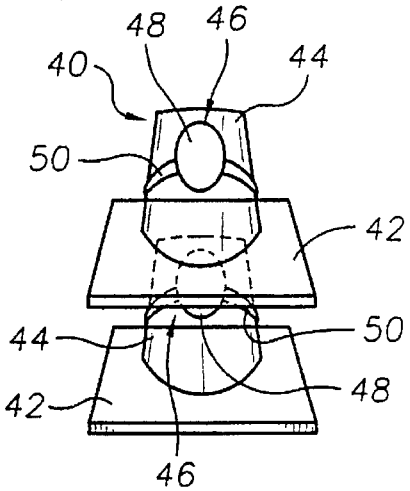
FIG. 4 is a schematic perspective view of the arrangement provided by two superposed ring pads when two ring trays of FIG. 1 are provided in a stacked relation.

With this arrangement, a plurality of ring trays 10 can be stacked upon each other, as shown, for example, in FIG. 2. In so doing, the bottom edge 20*a* of peripheral outer tray supporting vertical wall 20 of each ring tray 10 is stackable upon peripheral short stacking ledge 22 of a lower ring tray 10. Thus, the strongest part of the side wall 14 of each tray stacks upon the strongest part of the side wall 14 of the next lower tray to provide the greatest stacking strength. Further, the use of peripheral inclined wall 24 functions to guide the bottom edge 20*a* of peripheral outer tray supporting vertical wall 20 of each ring tray 10 onto peripheral short stacking ledge 22 of the next lower ring tray 10. As will be appreciated from the discussion which follows, ring trays 10 can be stacked one upon the other with the rings in one tray being untouched by the ring tray 10 stacked thereon.

Frame 12 further includes a planar supporting wall 28 secured to and within the confines of peripheral side wall 14. Specifically, supporting wall 28 is secured to the lower edge of peripheral inner supporting vertical wall 26 so as to extend transversely inwardly therefrom.

A plurality of intersecting walls 30 are formed on the upper surface of planar supporting wall 28. As shown, outer peripheral ones of intersecting walls 30 are connected with inner grid supporting vertical wall 26, and extend to the same height thereof. Further, intersecting walls 30 meet at junctions 32 having a generally four-sided hypocycloid configuration. As a result, intersecting walls 30 and junctions 32 define a plurality of recesses 34 of a generally square shape and having slightly rounded corners. Although ten recesses 34 are shown in a 2×5 matrix structure, it will be appreciated that the number and shape of recesses 34 can vary within the scope of the present invention. In addition, in accordance with an important aspect of the present invention, a generally square through hole 36 is provided in planar supporting wall 28 in each recess 34. However, through hole 36 may have other suitable shapes as will be apparent from the discussion hereinafter.

In order to retain rings on jewelry tray 10, a plurality of deformable and resilient pads 40 are provided. As shown, each pad 40 has a substantially square planar support 42 with slightly rounded corners, and with dimensions similar to those of recesses 34. A ring support or post 44 is integrally formed on the upper surface of planar support 42. Ring post 44 has a tapered cylindrical or frusto-conical shape and extends upwardly at an acute angle of, for example, 45°, from planar support 42. Further, according to an important aspect of the present invention, ring post 44 is hollow and is open at its lower end 44*a*, in alignment with an opening 42*a* in planar support 42. The upper end of ring post 44 is preferably closed.

In this regard, pad 40 is formed as an integral molded piece of planar support 42 and ring post 44, and is made from a flexible plastic or rubber material.

Figure 3:
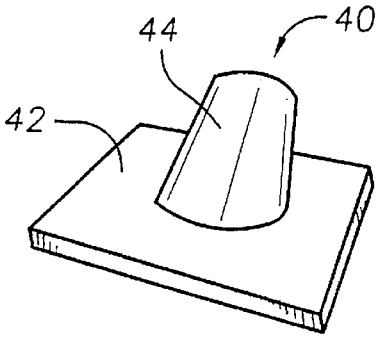
FIG. 3 is a perspective view of one of the pads of the ring tray of FIG. 1.
Figure 3A:
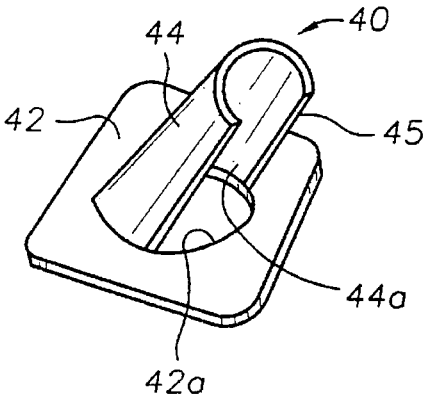
FIG. 3A is a perspective view of a modified ring post of a pad according to the present invention.

Alternatively, as shown in FIG. 3A, the rear portion of ring post 44 can be cut-away, along an arc of about 180° to form a rear open portion 45. In this regard, a tag on a ring can be fit within ring post 44 so that only the ring is visible.

Figure 3B:
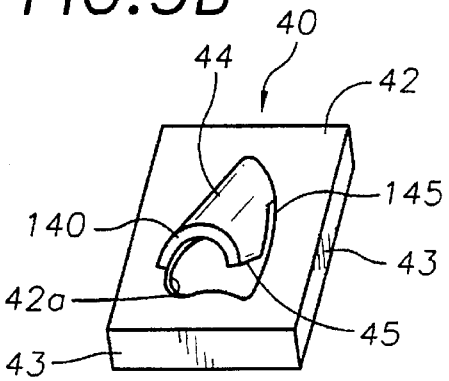
FIG. 3B is a perspective view of a modified ring post of a pad according to the present invention, similar to FIG. 3A.
Figure 5:
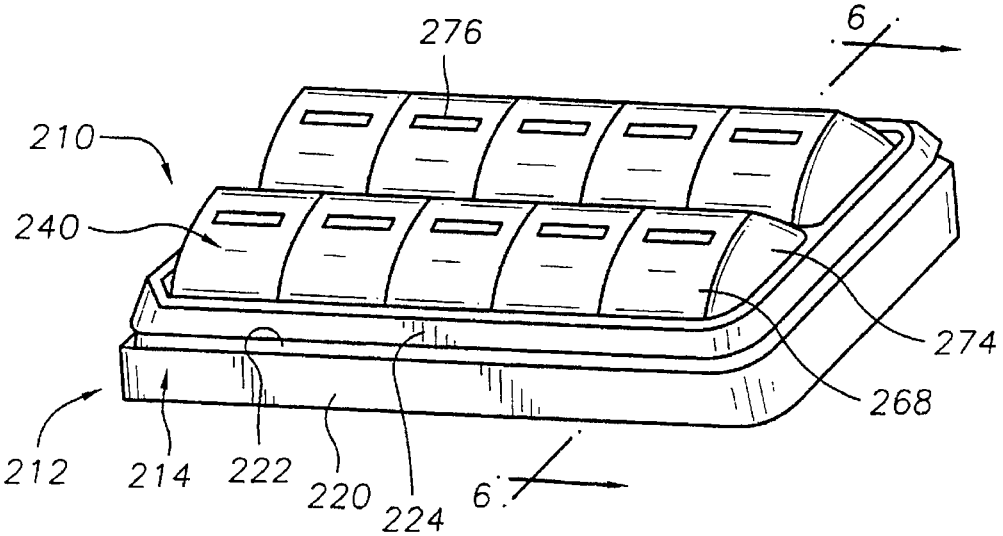
FIG. 5 is a perspective view of a ring tray according to still another embodiment of the present invention.

Another modification similar to FIG. 3A is shown in FIG. 3B. As shown therein, to provide sufficient structural rigidity to hold a ring thereon, the upper free end of ring post 44 can be provided with an arcuate portion 140 integrally secured thereat.

In addition, a portion of the lower end of ring post 44 at the rear thereof is detached from planar support 42 at opposite sides thereof, as at 145. This provides that different size rings fit on ring post 44 will force ring post 44 into the appropriate angular position, that is, with the ring band abutting against planar support 42 at openings 42*a* thereof to move ring post 44 to the appropriate angle. By providing for detached lower portions 145 of ring post 44, such angular adjustment can be provided.

Still further, in the embodiment of FIG. 3A, a peripheral side wall 43 is secured to the periphery of planar support 42 to support the same in a jewelry tray.

As a modification of tray 10, and as shown by dashed lines in the upper tray of FIG. 2, a tray 10 may include a small hollow, frusto-conical hump 15 in each recess 34 and on which a respective ring post 44 is slidably fitted on so as to provide additional support for the ring post 44, while still permitting a ring from a lower tray to protrude therethrough, in the manner which will be described in greater detail hereinafter.

Referring to FIG. 2, a ring tray 110 according to another embodiment of the invention will now be described in which elements corresponding to ring tray 10 are identified by the same reference numerals, augmented by 100.

Specifically, in ring tray 110, pads 40 are eliminated. In place thereof, ring posts 144 are integrally molded on the upper surface of planar supporting wall 128. Each ring post 144 has a tapered cylindrical or frusto-conical shape and extends upwardly at an acute angle of, for example, 45°, from planar supporting wall 128 within each recess 134. Further, according to an important aspect of the present invention, each ring post 144 is hollow and is open at its lower end 144*a*, in alignment with the respective through hole 136 in planar supporting wall 128.

Although not shown, it will be appreciated that intersecting side walls 130 of ring tray 110 may be eliminated, since there are no pads 40 to position therein.

Further, the rear portion of each ring post 144 can be cut-away, along an arc of about 180° to form a rear open, as in FIG. 3A, for fitting a tag on a ring within ring post 144 so that only the ring is visible.

FIG. 2 shows a ring tray 10 stacked upon a ring tray 110. As is clear therefrom, a ring 46 having a setting 48 secured to a band 50, can be mounted on each ring post 44 and 144. Specifically, the band 50 of each ring 46 is slid over a respective ring post 44 or 144 and is held thereon. When the ring trays 10 and 110 (or two ring trays 10 or two ring trays 110) are stacked on each other, as shown, the setting 48 and any gem stones or the like therein, from a ring 46 mounted on lower tray 110, extends through the respective through hole 36 in tray 10 and the respective opening 42*a* in planar support 42, and then into the hollow ring post 44.

As a result, by using a ring tray having hollow ring posts that receive rings from another tray on which it is stacked, whether part of a pad or integrally formed with the ring tray, the ring trays each have a reduced height in comparison with known ring trays. Further, such ring trays use a reduced amount of material in comparison with conventional ring trays. More importantly, such ring trays are easier and more economical to manufacture than conventional ring trays, since there is no need to nail the ring posts to a support and then cover the same with fabric.

Still further, with such arrangement, the ring trays 10 and 110 can be stacked one upon the other so as to all face in the same direction, that is, so that ring posts 44 and 144 are facing in the same direction. With conventional ring trays having a honeycomb bottom closing member, it has been required that the stacked ring trays alternately be turned by 180°. This requires turning of the ring trays when unstacking the same. Thus, with the present invention, the rings are stacked one directly above the other in the stacked relation of the ring trays.

Further, as shown in FIG. 2, such arrangement can be used with pads 52 of a conventional nature, which are used to hold earrings and other jewelry items. In such case, the setting 48 would extend to the underside of pads 52.

It will be appreciated that, although posts 44 have been described as being used with rings, they can just as easily be used with bracelets, bangles and watch bands.

Referring now to FIGS. 5–9, a ring tray 210 according to another embodiment of the invention will now be described in which elements corresponding to ring tray 10 are identified by the same reference numerals, augmented by 200. As shown there, ring tray 210 includes a molded generally rectangular frame 212 made from a tough, lightweight plastic. Although frame 212 is shown in a rectangular configuration, it is not so limited. As shown, frame 212 includes a peripheral side wall 214, which is formed in a substantially rectangular configuration. Side wall 214 is formed by a peripheral outer tray supporting vertical wall 220, a peripheral short stacking ledge 222 extending inwardly from the upper edge of peripheral outer tray supporting vertical wall 220, a peripheral inclined wall 224 extending inwardly and upwardly from the inner edge of peripheral short stacking ledge 222, and a peripheral inner supporting vertical wall 226 extending downwardly from the inner, upper edge of peripheral inclined wall 224 so as to be parallel and spaced inwardly of peripheral outer tray supporting vertical wall 220.

Figure 6:
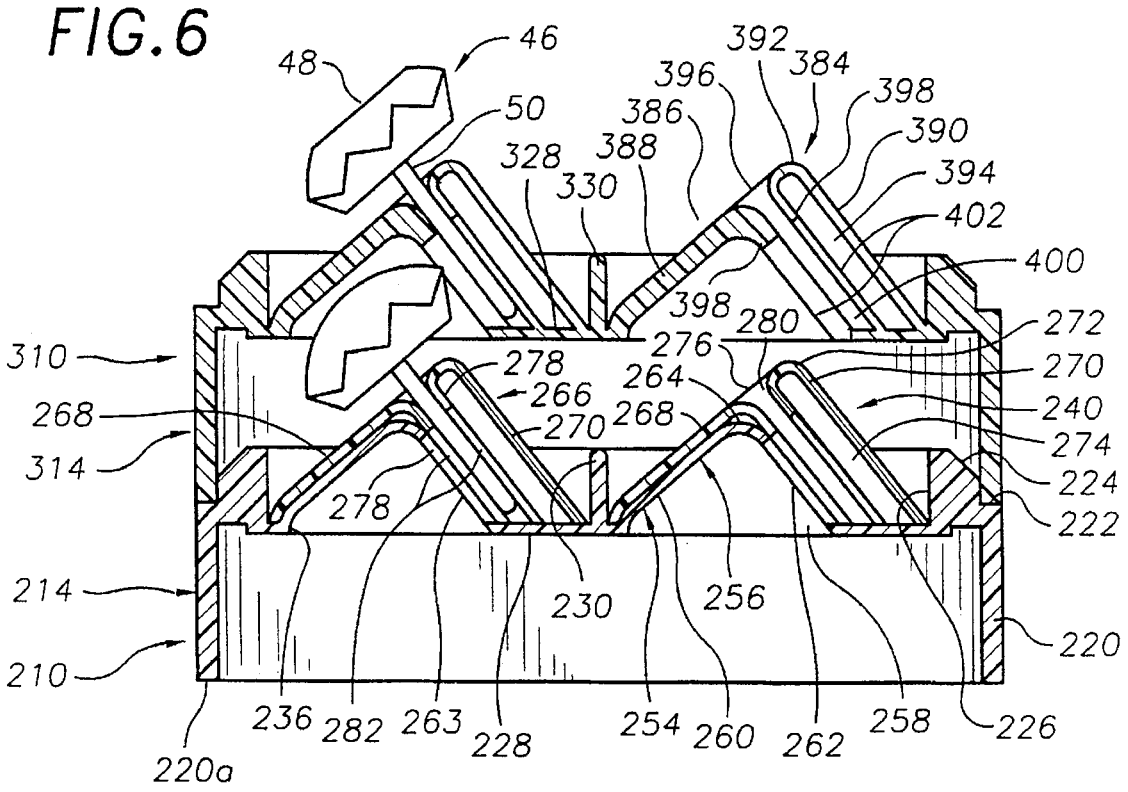
FIG. 6 is a cross-sectional view of the ring tray of FIG. 5, taken along line 6—6 thereof, stacked upon a ring tray according to yet another embodiment of the present invention.
Figure 7:
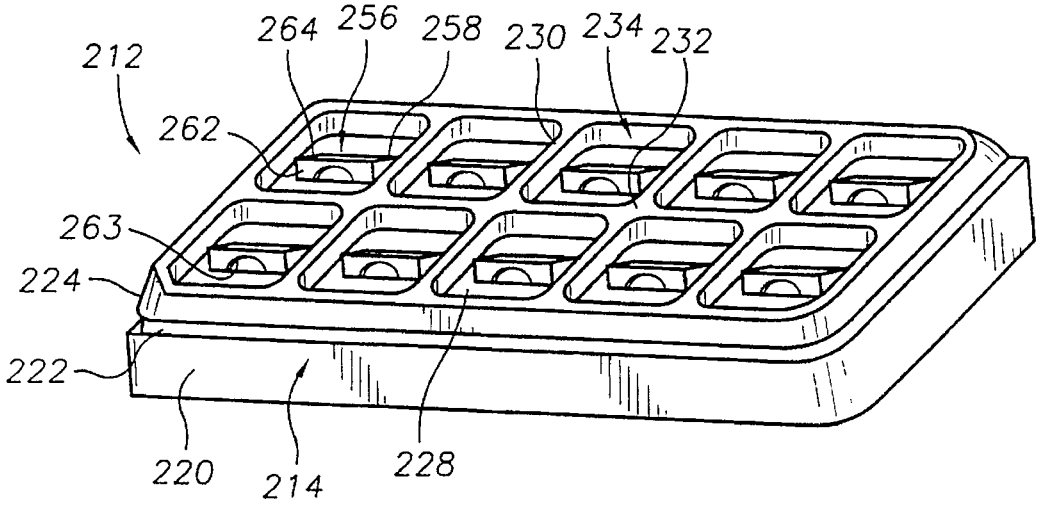
FIG. 7 is a perspective view of the frame of the ring tray of FIG. 5.

With this arrangement, a plurality of ring trays 210 can be stacked upon each other, as shown, for example, in FIG. 6. In so doing, the bottom edge 220*a* of peripheral outer tray supporting vertical wall 220 of each ring tray 210 is stackable upon peripheral short stacking ledge 222 of a lower ring tray 210. Thus, the strongest part of the side wall 214 of each tray stacks upon the strongest part of the side wall 214 of the next lower tray to provide the greatest stacking strength. Further, the use of peripheral inclined wall 224 functions to guide the bottom edge 220*a* of peripheral outer tray supporting vertical wall 220 of each ring tray 210 onto peripheral short stacking ledge 222 of the next lower ring tray 210. As will be appreciated from the discussion which follows, ring trays 210 can be stacked one upon the other with the rings in one tray being untouched by the ring tray 210 stacked thereon.

Frame 212 further includes a planar supporting wall 228 secured to and within the confines of peripheral side wall 214. Specifically, supporting wall 228 is secured to the lower edge of peripheral inner supporting vertical wall 226 so as to extend transversely or horizontally inwardly therefrom.

A plurality of intersecting walls 230 are formed on the upper surface of planar supporting wall 228. As shown, outer peripheral ones of intersecting walls 230 are connected with inner grid supporting vertical wall 226, and extend to the same height thereof. Further, intersecting walls 230 meet at junctions 232 having a generally four-sided hypocycloid configuration. As a result, intersecting walls 230 and junctions 232 define a plurality of recesses 234 of a generally square shape and having slightly rounded corners. Although ten recesses 234 are shown in a 2×5 matrix structure, it will be appreciated that the number and shape of recesses 234 can vary within the scope of the present invention. In addition, in accordance with an important aspect of the present invention, a generally square through hole 236 is provided in planar supporting wall 228 in each recess 234.

In addition, in each recess 234, there is a tent-shaped supporting wall structure 254 integrally formed on the upper surface of planar supporting wall 228 in surrounding relation to each through hole 236. Specifically, each tent-shaped supporting wall structure 254 includes an inverted V-shaped wall 256 closed at opposite sides thereof by triangular side walls 258. Inverted V-shaped wall 256 is formed by a front inclined wall 260 and a rear inclined wall 262 which meet along an apex line 264. As shown best in FIG. 7, each rear inclined wall 262 includes a substantially semi-circular cut-out area 263 therein. It will be appreciated that cut-out area 263 is not limited to a semi-circular configuration. Alternatively, cut-out area 263 can be eliminated to provide a better aesthetic appearance to ring tray 210.

In order to retain rings on jewelry tray 10, a plurality of deformable and resilient pads 240 are provided. As shown, each pad 240 is formed with an inverted V-shaped wall 266. The width of inverted V-shaped wall 266 is similar to the width of inverted V-shaped wall 256. Inverted V-shaped wall 266 is formed by a front inclined wall 268 and a rear inclined wall 270 which meet along an apex line 272. Preferably, the lengthwise dimension of V-shaped wall 266 is the same as the length of each recess 234 so that lower edges of walls 268 and 270 abut against lower ends of intersecting walls 230 that define recesses 234.

Further, inverted V-shaped wall 266 is closed at opposite sides thereof by triangular side walls 274 so as to cover triangular side walls 258, and thereby prevent side to side movement of a pad 240 on inverted V-shaped wall 256.

Front inclined wall 268 of each pad 240 further includes an elongated slot 276 extending in the widthwise direction thereof. A pair of parallel spaced apart guiding walls 278 are integrally formed at the undersurface of front inclined wall 268 on opposite sides of elongated slot 276, and extend downwardly therefrom substantially parallel to rear inclined wall 270, and form a cavity therebetween. It will be appreciated that both guiding walls 278 are spaced forwardly of rear inclined wall 270. Further, side edges of guiding walls 278 are connected together by end walls 280, although this is not essential. The distance between guiding walls 278 is generally less than the cross-sectional diameter of the ring band 50 so that guiding walls 278 are biased outwardly when ring band 50 is inserted therein, and whereby guiding walls 278 function to releasably grip ring band 50 inserted therein. In this regard, pad 240, including guiding walls 278, is formed as an integral molded piece and is made from a flexible plastic or rubber material.

Figure 8:
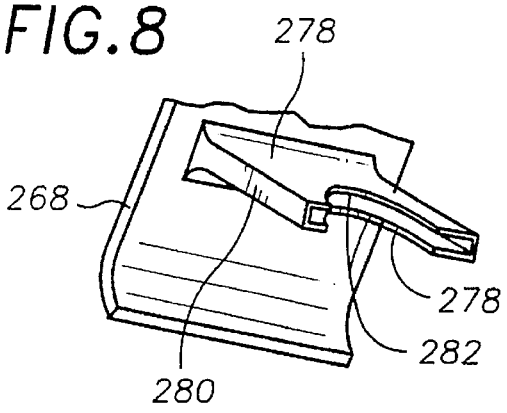
FIG. 8 is a bottom perspective view of a portion of one of the pads of the ring tray of FIG. 5.
Figure 9:
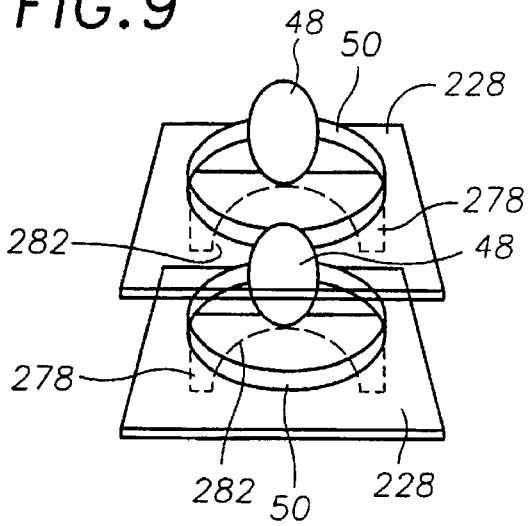
FIG. 9 is a schematic perspective view of the arrangement provided by two superposed ring pads when two ring trays of FIG. 5 are provided in a stacked relation.

As shown best in FIG. 8, guiding walls 278 have aligned substantially semi-circular cut-out areas 282 at their lower ends, the purpose for which will be apparent from the discussion which follows. It will be appreciated that cut-out areas 282 are not limited to a semi-circular configuration.

Thus, when pad 240 is seated on tent-shaped supporting wall structure 254, front inclined wall 268 rests on front inclined wall 260, and the forwardmost guiding wall 278 rests on rear inclined wall 262 so that cut-out areas 282 are substantially in alignment with the respective cut-out area 263. Thereafter, when a ring band 50 is positioned within the cavity between guiding walls 278, the circular area circumscribed by ring band 50 is in alignment with cut-out areas 263 and 282.

As an alternative to the above arrangement, tent-shaped supporting wall structure 254 may be eliminated, and pads 240 may be used without such structure.

Figure 10:
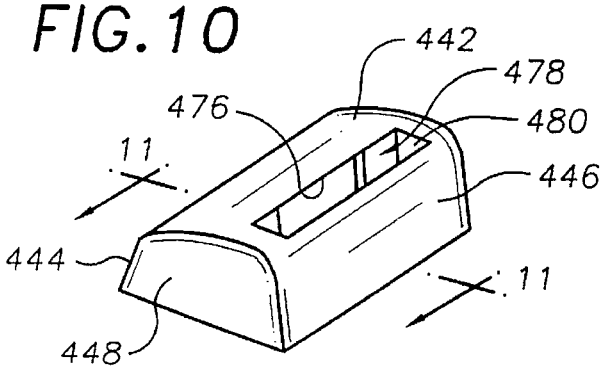
FIG. 10 is a top perspective view of a ring pad according to another embodiment of the present invention.
Figure 11:
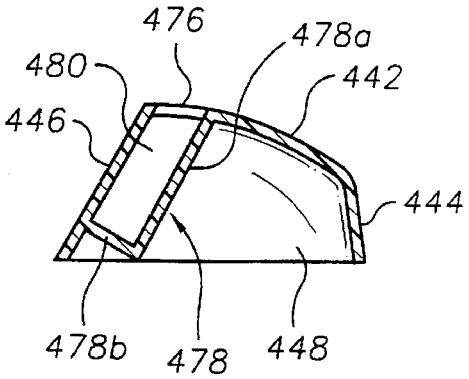
FIG. 11 is a cross-sectional view of the ring pad of FIG. 10, taken along line 11—11 thereof.
Figure 12:
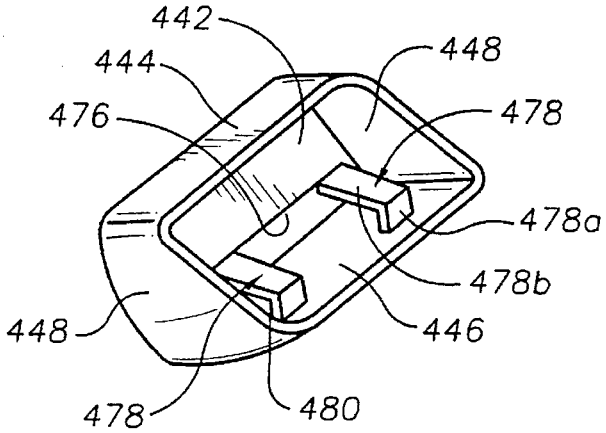
FIG. 12 is a bottom perspective view of the ring pad of FIG. 10.

Alternatively, in the latter case, a modified pad 440 may be used, as shown in FIGS. 10–12. Specifically, pad 440 includes a substantially rectangular upper inclined wall 442 that extends upwardly and rearwardly from a short vertical front wall 444 at an inclination of about 15°, and terminates in a rearwardly inclined rear wall 446. Preferably, inclined wall 442 has a slightly convex bowed configuration, and rear wall 446 is inclined rearwardly and downwardly at an inclination of about 25°. Side walls 448 connect upper inclined wall 442, front wall 444 and rear wall 446. With this arrangement, the lower edges of front wall 444, rear wall 446 and side walls 448 lie in the same horizontal plane and support pad 440 on a flat surface.

Preferably, each pad 440 is made from a flexible plastic material that can be deformed but which retains its shape when the deformation force is removed. Alternatively, each pad 440 can be made of a rubber material. In any event, it will be appreciated that each pad 440 has a substantially constant thickness throughout.

Upper inclined wall 442 of each pad 440 further includes an elongated slot 476 extending in the widthwise direction thereof, with elongated slot 476 being positioned at the rear edge of inclined wall 442. Thus, unlike elongated slot 276, elongated slot 476 is not spaced from the upper edge of rear wall 446.

Two narrow L-shaped guiding walls 478 are integrally connected at the undersurface of upper inclined wall 442 and the inner surface of rear wall 446, in spaced relation to each other and on opposite sides of elongated slot 476. Specifically, each L-shaped guiding wall 478 includes a short leg 478*a* substantially parallel to the upper inclined wall 442, with one edge connected to the inner surface of rear wall 446 at the lower end thereof, and a long leg 478*b* substantially parallel to rear wall 446, with one short edge thereof connected to the undersurface of upper inclined wall 442 immediately in front of elongated slot 476 and the opposite short edge thereof connected to the opposite edge of short leg 478*a*. The outer edges of each L-shaped guiding wall 478 are connected with an end wall 480, which is also connected to the inner surface of rear wall 446.

Thus, a ring band 50 can be inserted through elongated slot 476 and held in place by guiding walls 478. Because guiding walls 478 are separated from each other in the widthwise direction of pad 440, a setting 48 of a ring 46 from a lower stacked tray can fit through the ring band 50 held by a pad 440 of an upper stacked tray, to provide the same advantages as pad 240.

Figure 13:
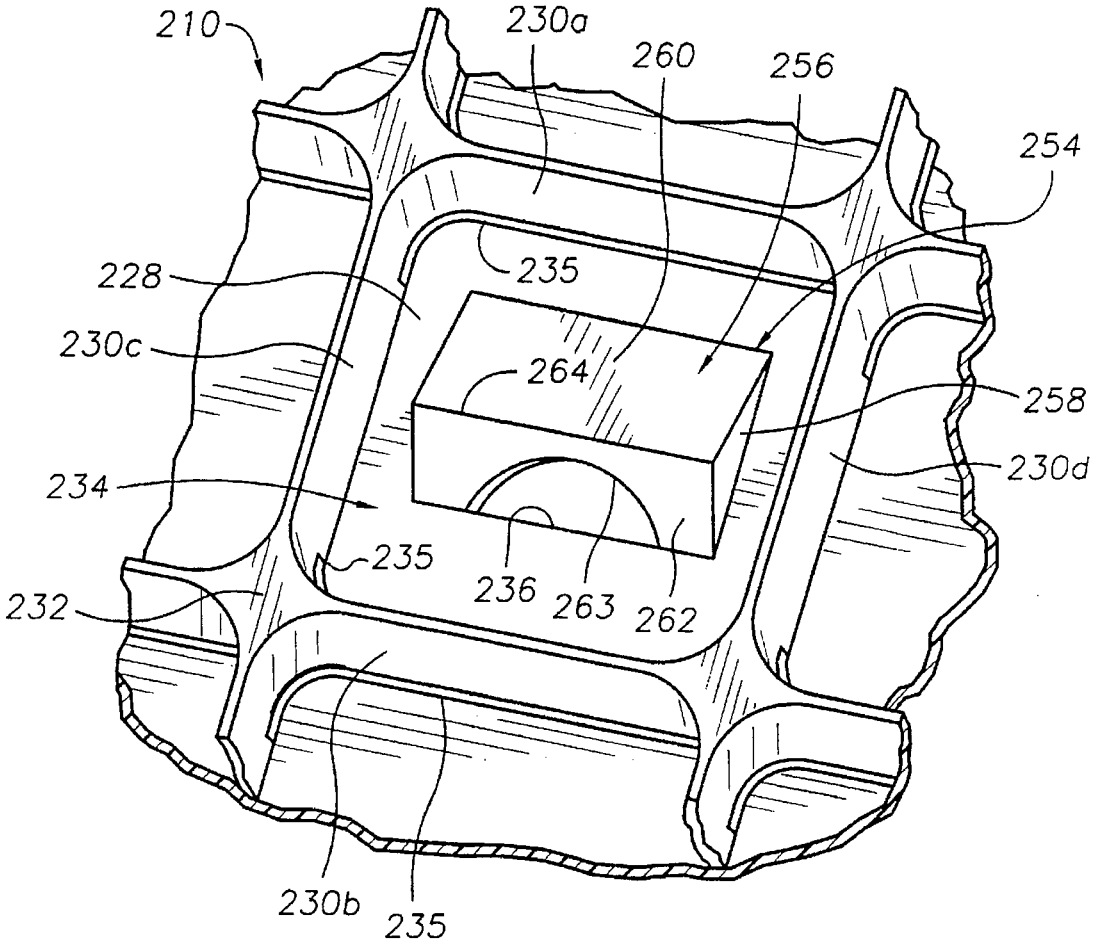
FIG. 13 is an enlarged perspective view of a modified frame of a ring tray according to another embodiment of the present invention.
Figure 14:
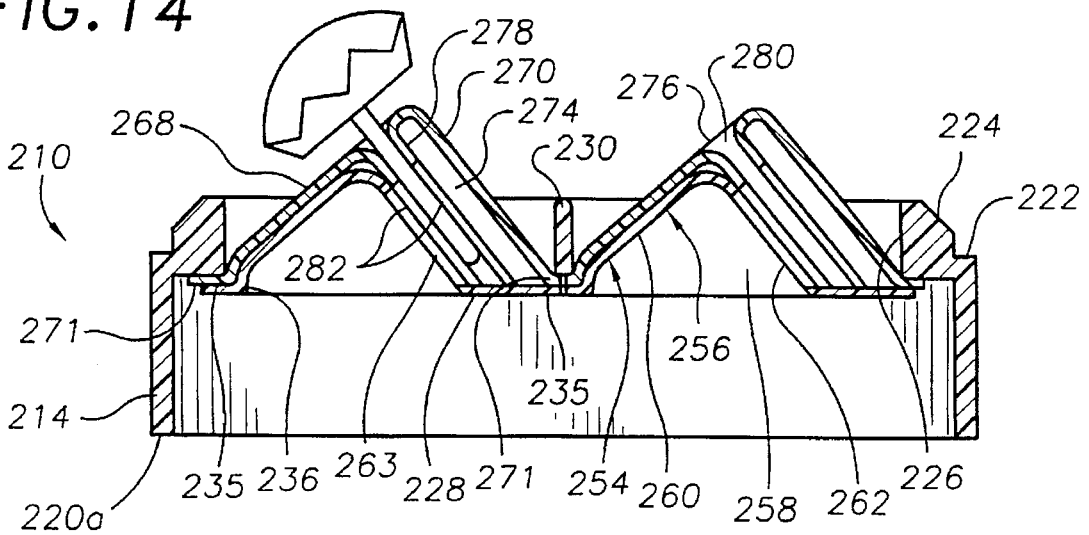
FIG. 14 is a cross-sectional view, similar to FIG. 6, of the modified frame of FIG. 13 with pads thereon.

Ring tray 210 can be modified as shown in FIGS. 13 and 14, in which the lower ends of opposite intersecting walls 230*a* and 230*b* in each recess 234 are cut away along the entire lengths of such walls 230*a* and 230*b* with each cut-away portion extending partially to the other two walls 230*c* and 230*d* of the same recess 234. Accordingly, opposing, substantially short U-shaped grooves 235 are formed at the lower ends of each recess 234. With this arrangement, the lower edges of front inclined wall 268 and rear inclined wall 270 of each pad 240 is biased by the material of the pad into the opposing grooves 235 to retain ring pads 240 in recesses 234. To remove ring pads 240, it is merely necessary to squeeze front inclined wall 268 and rear inclined wall 270 of each pad 240, whereupon the lower edges of front inclined wall 268 and rear inclined wall 270 of each pad 240 exit from opposing grooves 235 so that pad 240 can be lifted up. However, in the absence of such pressure, the lower edges of front inclined wall 268 and rear inclined wall 270 of each pad 240 are captured in each recess 234 and cannot accidently fall out therefrom. In order to aid in the capture of such pads 240, outwardly turned lips 271 may be provided at the lower edges of front inclined wall 268 and rear inclined wall 270 of each pad 240, for engagement within grooves 235.

It will be appreciated that, in the ring tray 210 of FIGS. 13 and 14, tent-shaped supporting wall structure 254 may be eliminated, and pads 240 may be used without such structure. Further, the use of grooves 235 can be used with any jewelry trays for holding any jewelry pads.

Referring to FIG. 6, a ring tray 310 according to another embodiment of the invention will now be described in which elements corresponding to those in ring tray 210 are identified by the same reference numerals, augmented by 100, and a detailed description of such common elements will be omitted for the sake of brevity.

Specifically, in ring tray 310, pads 240 and tent-shaped supporting wall structure 254 are eliminated. In place thereof, the structure of pads 240 is integrally connected to by being molded with planar supporting wall 328.

Thus, a tent-shaped wall structure 384 is provided in place of each pad 240, but having a shape and dimensions similar to pad 240. Tent-shaped wall structure 384 is formed with an inverted V-shaped wall 386 having a front inclined wall 388 and a rear inclined wall 390 which meet along an apex line 392. Preferably, the lengthwise dimension of V-shaped wall 386 is the same as the length of each recess 334. Further, inverted V-shaped wall 386 is closed at opposite sides thereof by triangular side walls 394.

Front inclined wall 388 further includes an elongated slot 396 extending in the widthwise direction thereof. A pair of parallel spaced apart guiding walls 398 are integrally formed at the undersurface of front inclined wall 388 on opposite sides of elongated slot 396, and extend downwardly therefrom in an orthogonal manner from front inclined wall 388, so as to form a cavity therebetween. The lower ends of guiding walls 398 are connected with planar supporting wall 328. Further, side edges of guiding walls 398 are connected together by end walls 400. The distance between guiding walls 398 is generally less than the cross-sectional diameter of the ring band 50 so that guiding walls 398 are biased outwardly when ring band 50 is inserted therein, and whereby guiding walls 398 function to releasably grip a ring band 50 inserted therein.

As with pads 240, guiding walls 398 of ring tray 310 have aligned substantially semi-circular cut-out areas 402 at their lower ends. Thus, when a ring band 50 is positioned within the cavity between guiding walls 398, the circular area circumscribed by ring band 50 is in alignment with cut-out areas 402.

Although not shown, it will be appreciated that intersecting side walls 330 of ring tray 310 may be eliminated, since there are no pads 240 to position therein.

FIG. 6 also shows a ring tray 310 stacked upon a ring tray 210. As is clear therefrom, a ring 46 having a setting 48 secured to a band 50, can be held between guiding walls 278 and 378. When the ring trays 210 and 310 (or two ring trays 210 or two ring trays 310) are stacked on each other, as shown, the setting 48 and any gem stones or the like therein, from a ring 46 mounted on lower tray 210, extends within the area defined by tent-shaped supporting wall structure 254 or tent-shaped wall structure 384. Because of cut-out areas 263, 282 and 402, the setting 48 and any gem stones or the like therein, can also extend through such cut-out areas and through the ring band 50 held by guiding walls 278 or 378. In the event that cut-out areas 263 are eliminated, that is, rear inclined wall 262 is solid, the setting 48 could only extend into the area defined by tent-shaped supporting wall structure 254.

As a result, by using ring tray 210 or 310, such inverted V-shaped structures receive settings 48 of rings 46 from another tray 210 or 310 on which it is stacked, whether the inverted V-shaped structures are formed as part of a pad or integrally formed with the ring tray. Thus, the ring trays each have a reduced height in comparison with known ring trays. Further, with such arrangement, the ring trays 210 and 310 can be stacked one upon the other so as to all face in the same direction. With conventional ring trays having a honeycomb bottom closing member, it has been required that the stacked ring trays be alternately turned by 180°. This requires turning of the ring trays when unstacking the same. Still further, when the settings 48 of rings 46 mounted to a lower ring tray 210 or 310 enter the cut-out areas 263 and 282, or 402, as well as the area circumscribed by ring bands 50 in the upper ring tray, an interlocking relation is provided, which tends to prevent accidental disengagement of the stacked ring trays.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention defined by the appended claims.

What is claimed is:

1. A jewelry tray comprising:

a frame including:

a peripheral supporting wall, and a supporting structure connected within said peripheral supporting wall, said supporting structure including a plurality of through holes therein; and a plurality of pads removably mounted on said supporting structure, each said pad including:

a support having an opening therein and removably mounted on said supporting structure in alignment with a respective said through hole, and a hollow post extending upwardly from said support in surrounding relation to said opening therein for supporting a jewelry item thereon.

2. A jewelry tray according to claim 1, wherein said hollow post has a substantially frusto-conical configuration.

3. A jewelry tray according to claim 1, wherein said support has a substantially planar surface and said post extends at an acute angle with respect to said planar surface.

4. A jewelry tray according to claim 1, wherein a rear portion of each said hollow post is open.

5. A jewelry tray according to claim 1, wherein said post is integrally molded with said support.

6. A jewelry tray according to claim 1, wherein said supporting structure includes a generally planar supporting wall connected to and between said peripheral supporting wall having said through holes therein, and said frame further includes a plurality of intersecting walls connected within said peripheral supporting wall and formed on said supporting structure so as to define a plurality of recesses for separately containing respective pads therein, with each through hole being provided in a respective said recess.

7. A jewelry tray according to claim 1, wherein said peripheral supporting wall includes:

outer tray supporting vertical wall means for supporting the jewelry tray on a surface;

short stacking ledge means, extending inwardly from an upper edge of the outer tray supporting vertical wall means, for supporting a bottom edge of the outer tray supporting vertical wall means of another said jewelry tray thereon; and inner supporting vertical wall means extending from said short stacking ledge means for supporting said supporting structure at a lower edge thereof.

8. A jewelry tray comprising:

a peripheral supporting wall;

a supporting structure connected within said peripheral supporting wall, said supporting structure including a plurality of through holes therein; and a plurality of hollow posts extending upwardly from said supporting structure, each said post being in surrounding relation to a respective said through hole for supporting a jewelry item thereon.

9. A jewelry tray according to claim 8, wherein said hollow post has a substantially frusto-conical configuration.

10. A jewelry tray according to claim 8, wherein said supporting structure has a substantially planar surface and each said post extends at an acute angle with respect to said planar surface.

11. A jewelry tray according to claim 8, wherein said post is integrally molded with said supporting structure.

12. A jewelry tray according to claim 8, wherein said supporting structure includes a generally planar supporting wall connected to and between said peripheral supporting wall, and said frame further includes a plurality of intersecting walls connected within said peripheral supporting wall and formed on said supporting structure so as to define a plurality of recesses, each said through hole being provided in the generally planar supporting wall in a respective said recess.

13. A jewelry tray according to claim 8, wherein a rear portion of each said hollow post is open.

14. A jewelry tray according to claim 8, wherein said peripheral supporting wall includes:

outer tray supporting vertical wall means for supporting the jewelry tray on a surface;

short stacking ledge means, extending inwardly from an upper edge of the outer tray supporting vertical wall means, for supporting a bottom edge of the outer tray supporting vertical wall means of another said jewelry tray thereon; and inner supporting vertical wall means extending from said short stacking ledge means for supporting said supporting structure at a lower edge thereof.

15. A jewelry pad for use with a frame including a peripheral supporting wall, and a supporting structure connected within said peripheral supporting wall, said supporting structure including a plurality of through holes therein, said jewelry pad comprising:

a support removably mountable on said supporting structure and having an opening therein for alignment with a respective said through hole when said support is removably mounted on said supporting structure, and a hollow post extending upwardly from said support in surrounding relation to said opening therein for supporting a jewelry item thereon, said opening in said support being substantially completely unobstructed such that a portion of a jewelry item on a second hollow post of a jewelry pad positioned below the first-mentioned jewelry pad can pass through said opening in said support into said hollow post of the first-mentioned jewelry pad.

16. A jewelry pad according to claim 15, wherein said hollow jewelry post has a substantially frusto-conical configuration.

17. A jewelry pad according to claim 15, wherein said support has a substantially planar surface and said post extends at an acute angle with respect to said planar surface.

18. A jewelry pad according to claim 17, wherein said acute angle is about 45°.

19. A jewelry pad according to claim 15, wherein said post is integrally molded with said support.

20. A jewelry pad according to claim 15, wherein a rear portion of said hollow post is open.

21. A jewelry pad according to claim 15, wherein said hollow post is tapered from a lower large diameter end up to a small diameter end, and the opening in said support has a diameter which is substantially the same as the diameter of the large diameter end of said hollow post such that the portion of the jewelry item on the second hollow post of the jewelry pad positioned below the first-mentioned jewelry pad can pass through said opening into said hollow post of the first-mentioned jewelry pad.

* * * * *